US010145000B2

(12) United States Patent
Cui et al.

(10) Patent No.: US 10,145,000 B2
(45) Date of Patent: Dec. 4, 2018

(54) THERMALLY DISSIPATIVE ARTICLE AND METHOD OF FORMING A THERMALLY DISSIPATIVE ARTICLE

(71) Applicant: GENERAL ELECTRIC COMPANY, Schenectady, NY (US)

(72) Inventors: Yan Cui, Greer, SC (US); Srikanth Chandrudu Kottilingam, Simpsonville, SC (US); Sandip Dutta, Greenville, SC (US); Brian Lee Tollison, Honea Path, SC (US)

(73) Assignee: General Electric Company, Schenectady, NY (US)

( * ) Notice: Subject to any disclaimer, the term of this patent is extended or adjusted under 35 U.S.C. 154(b) by 229 days.

(21) Appl. No.: 15/167,201

(22) Filed: May 27, 2016

(65) Prior Publication Data

US 2017/0342540 A1 Nov. 30, 2017

(51) Int. Cl.
*C23C 4/134* (2016.01)
*C23C 4/129* (2016.01)
(Continued)

(52) U.S. Cl.
CPC ..... *C23C 4/134* (2016.01); *B22F 3/1121* (2013.01); *B22F 3/1134* (2013.01); *B22F 5/009* (2013.01); *B22F 5/04* (2013.01); *B22F 7/08* (2013.01); *C23C 4/06* (2013.01); *C23C 4/073* (2016.01); *C23C 4/12* (2013.01); *C23C 4/129* (2016.01); *C23C 4/18* (2013.01); *C23C 24/04* (2013.01); *C23C 28/3215* (2013.01); *C23C 28/34* (2013.01); *C23C 28/36* (2013.01); *F01D 5/288* (2013.01); *B22F 2003/242* (2013.01); *B22F 2999/00* (2013.01); *F05D 2230/22* (2013.01); *F05D 2300/514* (2013.01)

(58) Field of Classification Search
CPC ..... C23C 4/134; C23C 4/129; C23C 4/06; C23C 24/04; F01D 5/288
USPC ..... 428/678
See application file for complete search history.

(56) References Cited

U.S. PATENT DOCUMENTS

| | | | | |
|---|---|---|---|---|
| 6,024,787 | A | 2/2000 | Lee | |
| 2009/0258214 | A1 | 10/2009 | Bayer et al. | |
| 2012/0159952 | A1* | 6/2012 | Arikawa | C23C 28/04 60/722 |
| 2015/0111060 | A1 | 4/2015 | Kottilingam et al. | |

FOREIGN PATENT DOCUMENTS

| | | | |
|---|---|---|---|
| CN | 104561881 | A | 4/2015 |
| EP | 1 496 140 | A1 | 1/2005 |
| EP | 2 881 489 | A1 | 6/2015 |

OTHER PUBLICATIONS

Banhart, J., "Manufacturing Routes for Metallic Foams," JOM, Solidification Science Overview, vol. 52, Issue 12, pp. 22-27 (Dec. 2000).

(Continued)

*Primary Examiner* — William K Cheung
(74) *Attorney, Agent, or Firm* — James W. Pemrick; Ernest G. Cusick; Frank A. Landgraff

(57) ABSTRACT

A thermally dissipative article and a method of forming a thermally dissipative article are disclosed. The thermally dissipative article includes a component, a porous material formed in a layer on the component. The method of forming a thermally dissipative article includes providing a metal powder mixture and a soluble particulate mixture which forms a porous coating upon sintering and immersion in a solvent to remove the soluble particulate.

18 Claims, 3 Drawing Sheets

(51) Int. Cl.

| | |
|---|---|
| ***C23C 4/06*** | (2016.01) |
| ***C23C 24/04*** | (2006.01) |
| ***C23C 4/12*** | (2016.01) |
| ***C23C 4/18*** | (2006.01) |
| ***C23C 4/073*** | (2016.01) |
| ***F01D 5/28*** | (2006.01) |
| ***B22F 3/11*** | (2006.01) |
| ***B22F 5/00*** | (2006.01) |
| ***B22F 5/04*** | (2006.01) |
| ***B22F 7/08*** | (2006.01) |
| ***C23C 28/00*** | (2006.01) |
| *B22F 3/24* | (2006.01) |

(56) References Cited

OTHER PUBLICATIONS

"Metal foam," Retrieved from the Internet URL: https://en.wikipedia.org/wiki/Metal_foam, on Mar. 27, 2018, pp. 1-8.

Extended European Search Report and Opinion issued in connection with corresponding EP Application No. 17172859.5 dated Nov. 13, 2017.

Weiguo Jiang, et al., Preparation and Properties of a Novel Water Soluble Core Material, J. Mater. Sci. Technol., 2010, 26(3), 270-275, ScienceDirect, http://www.sciencedirect.com/science/article/pii/S100503021060045X, Retrieved May 20, 2016.

* cited by examiner

THERMALLY DISSIPATIVE ARTICLE AND METHOD OF FORMING A THERMALLY DISSIPATIVE ARTICLE

FIELD OF THE INVENTION

The present invention is directed to thermally dissipative articles and methods of forming thermally dissipative articles. More specifically, the present invention is directed to articles having thermally dissipative layered porous material over at least a portion of the surface of the article and a method of forming an article having thermally dissipative porous material.

BACKGROUND OF THE INVENTION

Operating temperatures of turbine systems are continuously being increased to provide increased efficiency. As the operating temperatures are increased, components of the turbine systems are modified to increase their temperature capability.

Common features of turbine system components include a variety of structures, base materials and surface treatments that are designed to provide cooling to a component of the system, such treatments including but not limited to, thermal, wear and corrosion barriers, cooling channels and microchannels on or near the surface of the component. There are benefits and disadvantages to all such features. In some particular examples, the cooling solutions are technically advantageous but are prohibitive due to cost and complexity, among other challenges.

A particular surface treatment of interest is layered coatings in the form of metallic foams or sponges, generically, porous coating structures. Examples of such porous coatings include foams made of aluminum. These are advantageous because they have very low specific weight and high compression strength combined with good energy absorption characteristics. The study of metallic foams has become attractive to researchers and engineers due to the range of potential applications for hot gas path articles such as turbines. Metallic foams are known and can be fabricated in three ways. According to one method, molten metals with adjusted viscosities are applied to an article or component of an article and are injected with gases or gas-releasing blowing agents which cause the formation of bubbles during their in-situ decomposition, thereby forming a porous coating. A second method involves the application to an article of supersaturated metal-gas systems under high pressure which initiates bubble formation whereby pressure and temperature control are employed to control formation of the foam to provide a porous coating. And a third method involves application of metal powders mixed with a blowing agent to the article and subjecting the mixture to heat treatment at temperatures near the melting point of the metal powder material, resulting in decomposition of the blowing agent and release of gas forcing the melting metal material to expand and forming a porous structure. Each of these known methods is costly and to the extent even in use, is typically suitable only for advanced technology components rather than broad use on turbine components.

There is a need in the art for alternatives to forming porous coating layers to provide cost effective thermal protection in turbine systems.

BRIEF DESCRIPTION OF THE INVENTION

In a first exemplary embodiment, a thermally dissipative article includes a component, at least one layer of thermally dissipative porous coating deposited onto at least a portion of a surface of the component, and at least a supplemental layer adjacent to the layer of thermally dissipative porous coating, the supplemental layer selected from one or more of a bond coat, a thermal barrier coat, and combinations of these.

In another exemplary embodiment, a precursor to a thermally dissipative article includes a component, a thermally dissipative pore forming coating composition deposited onto at least a portion of a surface of the component and including a mixture of metal powders that includes at least one of each of a high melt metal powder and a low melt metal powder. The composition also includes a mixture that includes at least one soluble particulate, the at least one soluble particulate being soluble in a solvent which does not solvate the mixture of metal powders. The precursor also includes at least a supplemental layer adjacent to the thermally dissipative pore forming coating composition, the supplemental layer applied to the surface of the component, and selected from one or more of a bond coat, a thermal barrier coat, and combinations of these.

In another exemplary embodiment, a method of forming a thermally dissipative article, includes applying to at least a portion of a surface of a component a thermally dissipative coating composition. The coating includes a mixture of metal powders comprising at least one of each of a high melt metal powder and a low melt metal powder, and a mixture comprising at least one soluble particulate, the mixture comprising at least one soluble particulate being soluble in a solvent which does not solvate the mixture of metal powders. The method further includes the steps of sintering the at least partially coated article at a temperature and time sufficient to form the thermally dissipative coating composition into a hardened coating, immersing the at least partially coated article in the solvent to form a coating with a density of inter-connected pores.

In another exemplary embodiment, a method of forming a thermally dissipative bi-layer bond coat system on a component includes the steps of applying a thermally dissipative coating composition to at least a portion of a surface of a component that comprises at least a bond coat, the thermally dissipative coating composition including a mixture of metal powders comprising at least one of each of a high melt metal powder and a low melt metal powder, and a mixture comprising at least one soluble particulate, the mixture comprising at least one soluble particulate being soluble in a solvent which does not solvate the mixture of metal powders, sintering the at least partially coated article to form the thermally dissipative coating composition into a hardened coating and immersing the at least partially coated article in the solvent to remove the soluble particulate, and applying a thermal barrier coat to at least a portion of a surface of the component after the step of applying the thermally dissipative coating composition and after the steps of sintering and immersion. The bond coat system includes a bond coat adhered to at least a portion of the article, a metallic thermally dissipative porous coating with interconnected pores adhered over the bond coat, and a thermal barrier coating adhered to the metallic thermally dissipative porous coating.

Other features and advantages of the present invention will be apparent from the following more detailed description, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided are thermally dissipative articles and methods of forming thermally dissipative articles that include at least a first coating layer of porous metallic material. Embodiments of the present disclosure, in comparison to articles and processes not using one or more of the features disclosed herein, increase the heat transfer efficiency of a component of an article, increase heat transfer efficiency increase diffusion of a cooling medium, increase component life, increase turbine efficiency, increase ease of fabrication, decrease component cost or are cost neutral, or a combination thereof.

Also provided in accordance with certain embodiments comprising supplemental layers selected from bond coating and thermal barrier coating (TBC), bi- or multi-layered thermally dissipative articles are provided. In various such embodiments, additional layers provide one or more benefits including reducing heat conduction to the component, providing enhanced TBC coating adherence which extends resistance to spalling and thereby enhances component life, and enabling use of thicker TBC as a result of the ability to select or tune the coefficient of thermal expansion of the porous coating to more closely match that of the TBC.

Figure 1:
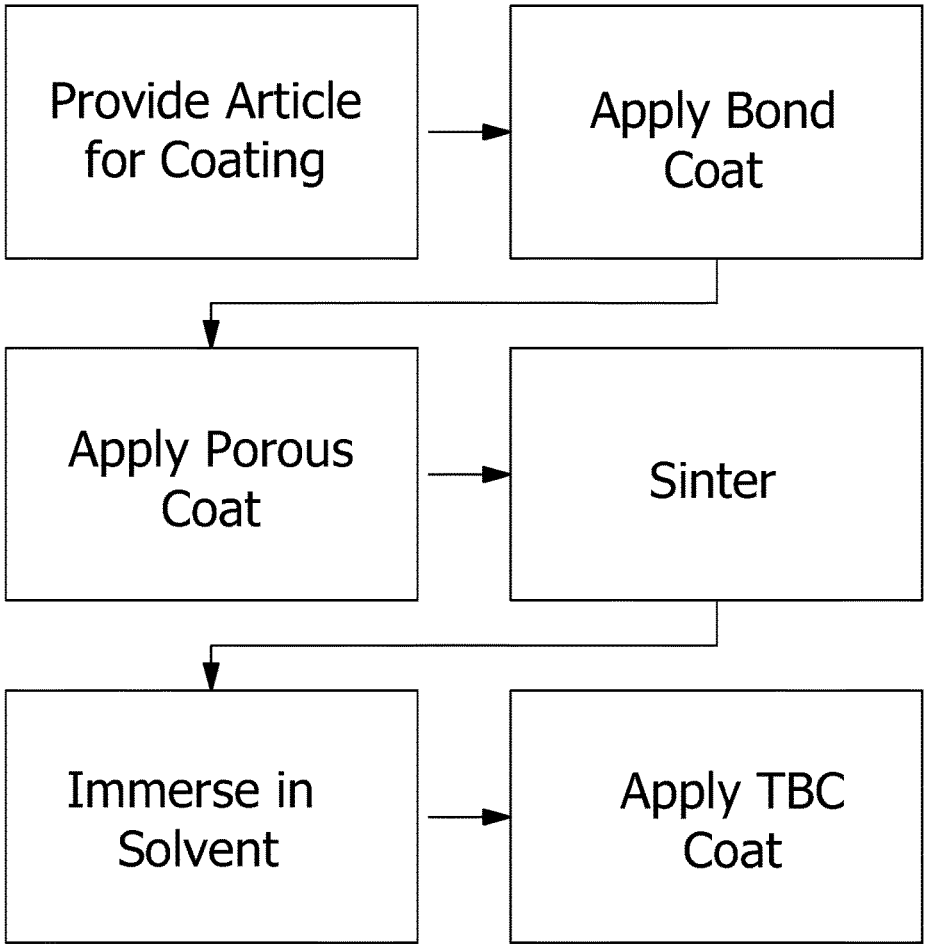
FIG. 1 is a flow diagram of the process steps for preparing a thermally dissipative article according to an embodiment of the disclosure.

Referring now to FIG. 1, in various embodiments, a thermally dissipative article may be prepared according to the process that includes the steps of providing at least a porous coating on at least a portion of the surface of a component. And as shown in FIG. 1, according to a particular embodiment, additional surface treatment coatings in the form of a bond coat and a thermal barrier coat (TBC) are also provided in addition to the porous coating. As will be further described herein, bond coats and TBCs are known in the art, and selection of the materials for each and the sequence of application to the component relative to the porous coating are within the skill in the art. In various embodiments, one or more of bond coats and TBCs may be applied to a component together with the thermally dissipative porous coating. Thus, in some embodiments, the thermally dissipative article includes a bond coat adjacent to the component, a thermally dissipative porous coating, and in some embodiments disposed on the surface there of a TBC.

Figure 2:
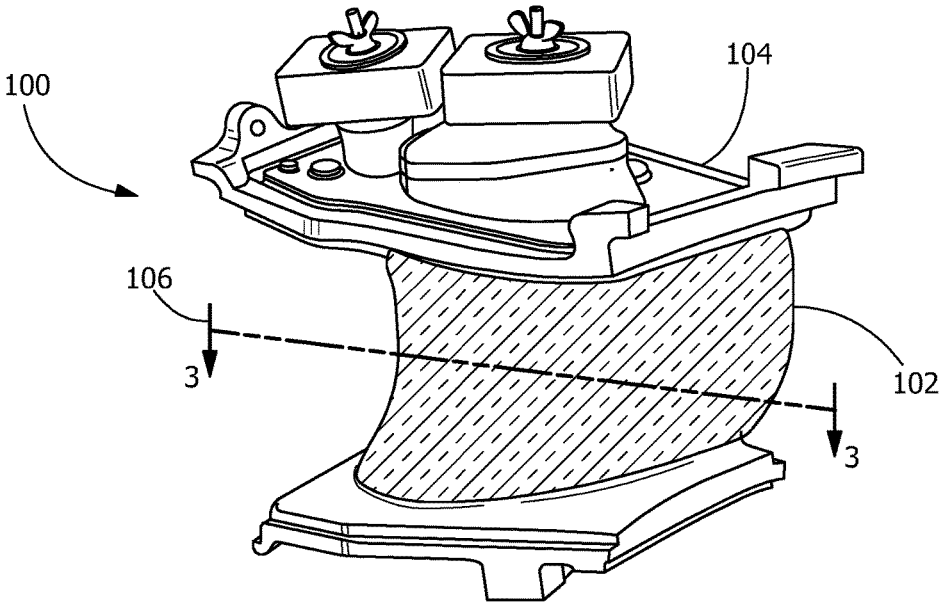
FIG. 2 is a side view of representative article of a turbine prepared according to an embodiment of the disclosure.
Figure 3:
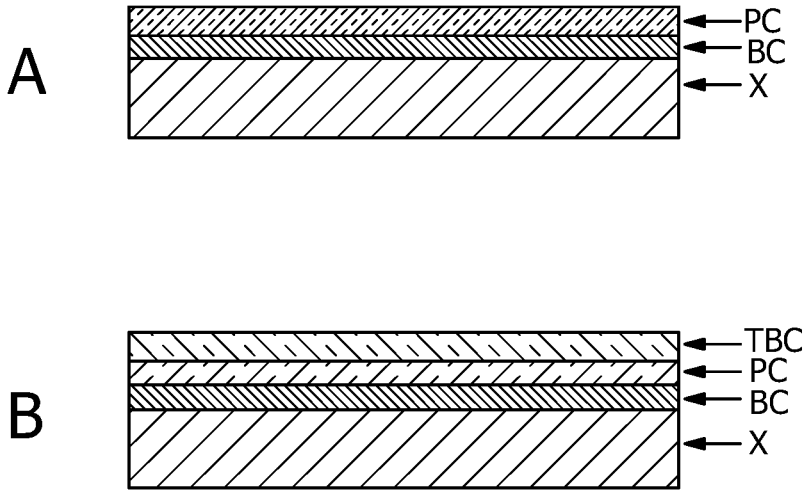
FIG. 3 is depicts surface treatment coating features of a first and a second representative article prepared according to alternate embodiments of the disclosure.

Referring now to FIG. 2, an exemplary embodiment of a thermally dissipative article 100 formed according to the disclosure is shown. This exemplary embodiment is a turbine nozzle, and as shown, the article comprises a thermally dissipative porous coating 102 on a portion of its surface, and comprises other surfaces that are not coated with a thermally dissipative porous coating, e.g., 104, the surface treatment features represented in a cross sectional portion defined by A-A 106, the details of which are shown in FIG. 3.

In accordance with the instant disclosure, porous metallic coatings that provide thermally dissipative articles according to the disclosure are formed on a component. Referring again to FIG. 1, a component or portion of a component is provided for formation of a porous thermally dissipative coating on at least a portion of a surface thereof. A porous coating composition comprises a metal powder and a pore forming powder. And more particularly, a porous coating composition comprise a metal powder mixture of high melting and low melting metal powders, and a pore forming particulate mixture including soluble, particularly water soluble, ceramic powder, each of which mixture includes one or a combination materials. The porous coating composition is applied to the component according to one of a variety of methods, for example, a spray process selected from thermal spray, cold spray, flame spray, and plasma spray.

The selection of the low-melt material and the high-melt material and the weight percentages thereof in various embodiments are varied based upon, for example, the operating temperature of the component, and the composition of any TBC and bond coat, and the features desired in the thermally dissipative porous coating. Further, the weight percentages of the metal powder mixture and the pore forming particulate mixture are determined based on the desired extent of porosity. In various embodiments, the low melting metal is present at a percentage by weight, based on the weight of the porous coating composition, from 30% to 60%, and more particularly from 35% to 55%, and more particularly from 40% to 50%. Thus, in various embodiments, the percentage by weight of the composition of the low melting metal may be 30, 31, 32, 33, 34, 35, 40, 45, 50, 55, 60 percent, and increments there between. And, in various embodiments, the pore forming particulate mixture is present at a percentage by weight, based on the weight of the porous coating composition, from 5% to 50%, and more particularly from 10% to 40%, and even more particularly from 15% to 30%. Thus, in various embodiments, the percentage by weight of the pore forming particulate mixture may be 5, 6, 7, 8, 9, 10, 11, 12, 13, 14, 15, 16, 17, 18, 19, 20, 21, 22, 23, 24 25, 30, 35, 40, 45, and 50 percent, and increments there between.

In one example according to the disclosure, the metal powder mixture includes a high melt metal powder selected from superalloy and MCrAlY alloy powders, where MCrAlY is an alloy having M selected from one or a combination of iron, nickel, cobalt, and combinations thereof; Cr is chromium, Al is aluminum, and Y is Y. According to such embodiments, the low melting metal powder is selected from low melting braze alloy powders. And according to such embodiments, the pore forming particulate mixture comprises a soluble ceramic powder. More particularly according to some embodiments, the pore forming particulate mixture comprising a soluble ceramic powder comprises components that are present, by weight percentage of the soluble ceramic powder, about 60% to 70% alumina flour ($Al_2O_3$), about 15% to 25% of zircon ($ZrSiO_4$) flour by weight, about 5% to 15% of sodium hydrogen phosphate ($Na_2HPO_4$) by weight, and about 5% by weight of sugar. Other suitable pore forming particulate materials that may be used in accordance with the various embodiments, include mixtures of soluble powders comprising components that are present, by weight percentage of the soluble powder: about 40% to 45% of polymeric polyols, for example the polyether diol polyethylene glycol; about 27% to 30% of insoluble particulates, for example, mica powder; about 23% to 25% of a common salt, for example, sodium chloride; and about 0% to 10% of a plasticizer, for example, a plasticizer formed from polyethylene and paraffin.

Other suitable high-melt metallic materials that may be used in accordance with the various embodiments include materials selected from R80, MM247, RN2, R142, R195, GT33, and combinations of these. Other suitable low-melt metallic materials that may be used in accordance with the various embodiments include materials selected from DF4B, BNi-2, BNi-5, B50TF285, D15, and combinations of these.

The methods and articles herein are useful in applications where materials are exposed to high temperatures, such as for example, components of gas turbines, and are formed of base materials selected from nickel based superalloys and cobalt based superalloys.

In accordance with the methods hereof, a thermally dissipative article is formed according to the steps including applying to at least a portion of a surface of a component a thermally dissipative coating composition comprising a mixture of metal powders comprising at least one of each of a high melt metal powder and a low melt metal powder, and a mixture comprising at least one soluble particulate, the mixture comprising at least one soluble particulate being soluble in a solvent which does not solvate the mixture of metal powders. After application to the component surface, the component is sintered at a temperature and time sufficient to form the thermally dissipative coating composition into a hardened coating. Thereafter, the sintered coated component is immersed in the solvent and removed therefrom, and optionally the steps of immersion and removal may be repeated to provide a coated article with a density of inter-connected pores. According to the various embodiments, the coating composition is applied by one of a variety of suitable methods known in the art, for example but not limited to, spray deposition according a process selected from thermal spray, cold spray, flame spray, and plasma spray.

Generally, the metal powder comprises particles that are in contact with adjacent particles in the applied coating composition, and will, upon partial or complete removal of the soluble particulate during processing, form a microstructure network interrupted by pores created by the at least one soluble particulate. Thus, prior to processing, the space occupied by the metal powder in the coating composition defines the solid matrix of the coating and the space occupied by the soluble particulates defines the pores. The amount of soluble particulate present relative to the amount of metal powder determines the extent of contact between the soluble particulate, and hence will affect the extent of pore interconnectedness. Likewise, the particle size distribution of the soluble particulate will affect the pore size distribution and pore wall thickness in the matrix network. Processing by heat treatment as described herein, followed by solvent immersion, will yield the porous coating having a network of pores within the metal matrix, the extent of interconnectedness and pore sizes selected based on the amount and size distribution of the soluble particle component of the coating composition. This network (resembling that of a sponge) is different than generally dense bond and TBC layers, the microstructures of which have a relatively low level of open porous space.

In accordance with some embodiments, thee method of forming a thermally dissipative article according further includes at least one additional step selected from applying a bond coat to at least a portion of a surface of the component prior to the step of applying the thermally dissipative coating composition, applying a bond coat to at least a portion of a surface of the component after the step of applying the thermally dissipative coating composition and after the steps of sintering and immersion, applying a thermal barrier coat to at least a portion of a surface of the component prior to the step of applying the thermally dissipative coating composition, and applying a thermal barrier coat to at least a portion of a surface of the component after the step of applying the thermally dissipative coating composition and after the steps of sintering and immersion.

In accordance with the disclosure, sintering is carried out at a temperature in the range from about 2000° F. to about 2350° F., for a time interval from about 5 minutes to about 60 minutes. In some particular embodiments, sintering is carried out at a temperature that is at least 2175° F., for a time interval from about 10 to about 15 minutes. Of course it will be appreciated by one of skill in the art that methods other than sintering for forming the hardened coating may be selected from the art, including Laser, Electron Beam, and Vacuum Plasma.

As an aspect of a process for forming a thermally dissipative article according to the disclosure, a precursor article is first formed, the precursor comprising a component and a thermally dissipative pore forming coating composition deposited onto at least a portion of a surface of the component, the coating composition comprising a mixture of metal powders comprising at least one of each of a high melt metal powder and a low melt metal powder, and a mixture comprising at least one soluble particulate, the at least one soluble particulate being soluble in a solvent which does not solvate the mixture of metal powders. In some such embodiments, the precursor is subject to sintering and solvent immersion to provide a porous coated component. In some such embodiments, the porous coated article is thereafter subjected to coating with one or more of a supplemental coat selected from a bond coat, a TBC, another protective coating, and combinations of these.

In other embodiments, the precursor is formed with a component that comprises at least a supplemental layer supplemental layer applied to the surface of the component, and selected from one or more of a bond coat, a thermal barrier coat, and combinations of these, the supplemental layer being adjacent to the thermally dissipative pore forming coating composition prior to sintering and immersion to form the porous coating. In some such embodiments, the precursor is subject to sintering and solvent immersion to provide a porous coated component. In some such embodiments, the porous coated article is thereafter subjected to coating with one or more of a supplemental coat selected from a bond coat, a TBC, another protective coating, and combinations of these.

A precursor to a thermally dissipative article according includes, in some embodiments, the coating composition which comprises a high melt metal powder selected from superalloy and MCrAlY alloy powders, the low melting metal powder is selected from low melting braze alloy powders, the mixture comprising at least one soluble particulate is a ceramic powder, the metal powders and ceramic powders present in the percentages as described herein above.

Referring again to FIG. 2, the exemplary embodiment of a thermally dissipative article 100, the thickness of the porous coating 102 is any suitable thickness for the component, based upon the design parameters of the component, the inclusion of one or more supplemental coatings according to the disclosure, and the physical and thermal dissipative properties intended. For example, in one embodiment, the thickness of the thermally dissipative porous coating 102 is matched to the thickness of a cooling microchannel or other structural feature of the component. For example, in some embodiments, the thickness of the thermally dissipative porous coating 102 may be, but is not limited to, about 4 mil up to about 40 mil, and more particularly between about 6 mil and about 20 mm. Thus, in various embodiments, the porous coating 102 may be 4, 5, 6, 7, 8, 9, 10, 11, 12, 13, 14, 15, 16, 17, 18, 19, 20, 21, 22, 23, 24 25, 30, 31, 32, 33, 34, 35, 36, 37, 38, 39 or 40 mils and increments there between.

In the various embodiments, a range of the porosity, or pore density, of the thermally dissipative porous material includes, but is not limited to, between about 5% and about 95%, between about 10% and about 90%, and between about 30% to about 50%, and any combination, sub-combination, range, or sub-range thereof. Therefore, the porosity of the porous coating may be about 5, 6, 7, 8, 9, or 10% or 20, 30, 40, 50, 60, 70, 80, 90% or more including increments of one or a fraction of percentages thereof, wherein the porosity constitutes void space and the remaining portion is solid metallic material selected present in a range from about 5% to about 95%, and increments there between. In accordance with the various embodiments, the pore density of a thermally dissipative porous coating may be varied to achieve selected or predetermined characteristics.

In the various embodiments, the pore size of individual pores in the thermally dissipative porous coating include any suitable pore size, such as, but not limited to, between about 2 mils and about 40 mils, between about 2 mils and about 30 mils, between about 2 mils and about 10 mils, and about 5 mils to about 15 mils. Therefore, the pore sizes may be about 2, 3, 4, 5, 6, 7, 8, 9, 10, 11, 12, 13, 14, 15, 16, 17, 18, 19, 20, 21, 22, 23, 24 25, 30, 31, 32, 33, 34, 35, 36, 37, 38, 39 or 40 mils. The pores may include any suitable shape, for example, overlapping spheres, overlapping cylinders, oblong pores oriented at different angles to each other, curved pores, irregular pores, or a combination thereof.

In accordance with the various embodiments, distribution of pores within a thermally dissipative porous coating may be uniform or variable as applied to a component surface, and may vary in one more dimensions. Thus, in accordance with the various embodiments, the size, density and distribution of pores may vary along one or more of the depth of the coating, along a length or width of the coating on the surface of the component. And in accordance with the various embodiments, a thermally dissipative porous coating may be applied to all of or a portion of a component surface. In one embodiment, the thermally dissipative porous coating is applied only to the exterior surface of a portion of a component, for example as shown in FIG. 2. In other embodiments, the thermally dissipative porous coating may be applied to all or a portion of one or more exterior and interior surfaces of a component.

In accordance with the various embodiments, supplemental coats including one or more bond coats and thermal barrier coats may be applied. Referring again to the drawings, FIG. 3 shows in panels A and B two alternate representative embodiments of layered coatings in accordance with the disclosure. In panel A, according to one embodiment, a layered surface treatment on a component includes a component substrate X over which is applied a bond coat BC, which is coated with a thermally dissipative porous coating PC. In panel B, and alternate embodiment is depicted where the cross section shows a layered surface treatment including a component substrate X over which is applied a bond coat BC, which is coated with a thermally dissipative porous coating PC, which is coated with a thermal barrier coating TBC. It will be appreciated by one of skill in the art that the number and layering of such coatings may be varied and that more than one of each form of coating may be used to provide surface treatment to a component, as well as other coating materials not described herein.

According to the disclosure, a bond coat includes any suitable material, for example, MCrAlX, where MCrAlX is an alloy having M selected from one or a combination of iron, nickel, cobalt, and combinations thereof; Cr is chromium, Al is aluminum, and X is an element selected from the group of solid solution strengtheners and gamma prime formers consisting of Y, Tc, Ta, Re, Mo, Si, and W and grain boundary strengtheners consisting of B, C, Hf, Zr, and combinations thereof. According to some embodiments, a TBC includes Yttria stabilized Zirconia.

The spray application process may be used for application of one or more of a bond coat and a thermal barrier coating to form such a coating having any suitable thickness. Suitable thicknesses of a bond coat and/or a thermal barrier coating include, but are not limited to, may be, but is not limited to, about 8 mils up to about 100 mils, and more particularly between about 8 mils to about 60 mils, and from about 20 mils to about 60 mils, and from about 80 mils to about 100 mils. Therefore, one or more of the bond and thermal barrier coating may be about 8, 9, 10, 11, 12, 13, 14, 15, 16, 17, 18, 19, 20, 21, 22, 23, 24 25, 30, 31, 32, 33, 34, 35, 36, 37, 38, 39, 40, 45, 50, 55, 60, 65, 70, 75 or 80 mils or increments there between.

In some embodiments, the thermally dissipative porous coating and optionally one or more supplemental coatings is applied to one or more structural features on a surface of a component, such as cooling channels or microchannels. Examples of cooling microchannels beneath and exterior surface of the component include, but are not limited to, near-surface microchannels, internal microchannels, or a combination thereof. In yet other embodiments, the thermally dissipative porous coating may be applied within or partially within one or more structural features. In some embodiments, an entrance and an exit of a cooling microchannel may be masked prior to the spray application of a bond coat and/or a thermal barrier coating and/or the thermally dissipative porous coating. The masking prevents the blocking of a masked portion of the holes in the component during the spray application. In some embodiments, one or more coats including the thermally dissipative porous coating may be applied and incorporated into one or a plurality of cooling features, such as cooling channels or microchannels on the component. In some embodiments, any supplemental bond coat and/or thermal barrier coating are not spray applied, or are only partially spray applied over the thermally dissipative porous coating, leaving exposed structural features in the component.

In accordance with a particular embodiment hereunder, as shown in representative example B in FIG. 3, a bi-layer bond coat system is contemplated that includes bond coat adhered metallic thermally dissipative porous coating with a thermal barrier coating applied thereto, where the materials and thicknesses of the TBC and the porous coating are selected based upon their respective coefficients of thermal expansion, as well as the materials' thermal conductivity and thermal diffusivity, to provide enhanced retention of the TBC on the component, increased resistance to the flow of heat from the TBC to the base metal, and increased TBC spall resistance.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A thermally dissipative article, comprising:

a component;

at least one layer of thermally dissipative porous coating deposited onto at least a portion of a surface of the component, wherein a pore size of individual pores in the thermally dissipative porous coating comprises between about 2 mils and about 40 mils;

at least one supplemental layer adjacent to the layer of thermally dissipative porous coating, the supplemental layer selected from one or more of a bond coat, a thermal barrier coat, and combinations of these.

2. A thermally dissipative article according to claim 1, wherein the thermally dissipative porous coating comprises a porosity of between about 5 percent and about 90 percent.

3. A thermally dissipative article according to claim 1, wherein the thermally dissipative porous coating is a metallic material that comprises one of a superalloy and a MCrAlY metal.

4. The thermally dissipative article of claim 3, wherein the thermally dissipative porous coating is adherent to a bond coat applied between the surface of the component and the thermally dissipative porous coating.

5. The thermally dissipative article of claim 4, wherein the thermally dissipative porous coating is coated by a thermal barrier coating.

6. A thermally dissipative article according to claim 5, wherein the component is a turbine component selected from shrouds, nozzles, blades, transition piece, and a liner.

7. A thermally dissipative article according to claim 6, wherein the component comprises at least one material selected from the group consisting of nickel based superalloys and cobalt based superalloys.

8. A precursor to a thermally dissipative article, comprising:

a component;

a thermally dissipative pore forming coating composition deposited onto at least a portion of a surface of the component, wherein a pore size of individual pores in the thermally dissipative porous coating is between about 2 mils and about 40 mils;

a mixture of metal powders comprising at least one of each of a high melt metal powder and a low melt metal powder, and a mixture comprising at least one soluble particulate, the at least one soluble particulate being soluble in a solvent which does not solvate the mixture of metal powders;

at least one supplemental layer adjacent to the thermally dissipative pore forming coating composition, the supplemental layer applied to the surface of the component, and selected from one or more of a bond coat, a thermal barrier coat, and combinations of these.

9. A precursor to a thermally dissipative article according to claim 8, wherein the high melt metal powder is selected from superalloy and MCrAlY alloy powders, the low melting metal powder is selected from low melting braze alloy powders, the mixture comprising at least one soluble particulate is a ceramic powder that comprises about 60 to 70% alumina flour ($Al_2O_3$) by weight, about 15 to 25% of zircon ($ZrSiO_4$) flour by weight, about 5 to 15 of sodium hydrogen phosphate ($Na_2HPO_4$) by weight, and about 5 by weight of sugar and the solvent is water.

10. A thermally dissipative article, comprising:

a turbine component;

at least one layer of a bond coating deposited onto at least a portion of a surface of the turbine component;

at least one layer of thermally dissipative porous coating deposited onto at least a portion of the bond coating, wherein a pore size of individual pores in the thermally dissipative porous coating is between about 2 mils and about 40 mils;

at least one supplemental layer deposited on the thermally dissipative porous coating, the supplemental layer selected from one or more of a bond coat, a thermal barrier coat, and combinations thereof.

11. The thermally dissipative article according to claim 10, wherein the at least one layer of a bond coating comprises MCrAlX, where MCrAlX is an alloy having M selected from one or a combination of iron, nickel, cobalt, and combinations thereof; Cr is chromium, Al is aluminum, and X is an element selected from the group of solid solution strengtheners and gamma prime formers consisting of Y, Tc, Ta, Re, Mo, Si, and W and grain boundary strengtheners consisting of B, C, Hf, Zr, and combinations thereof.

12. The thermally dissipative article according to claim 10, wherein the thermally dissipative porous coating comprises a porosity of between about 5 percent and about 90 percent.

13. The thermally dissipative article according to claim 10, wherein the thermally dissipative porous coating is a metallic material that comprises one of a superalloy and a MCrAlY metal, where MCrAlY is an alloy having M selected from one or a combination of iron, nickel, cobalt, and combinations thereof; Cr is chromium, Al is aluminum, and Y is yttrium.

14. The thermally dissipative article of claim 13, wherein the thermally dissipative porous coating is coated by a thermal barrier coating.

15. The thermally dissipative article according to claim 14, wherein the component comprises at least one material selected from the group consisting of nickel based superalloys and cobalt based superalloys.

16. The thermally dissipative article according to claim 10, the at least one layer of thermally dissipative porous coating comprising:

a mixture of metal powders comprising a high melt metal powder and a low melt metal powder, and a water soluble ceramic powder.

17. The thermally dissipative article according to claim 16, the high melt metal powder selected from MCrAlY alloy powders, where MCrAlY is an alloy having M selected from one or a combination of iron, nickel, cobalt, and combinations thereof; Cr is chromium, Al is aluminum, and Y is yttrium;

the low melt metal powder is a braze alloy powder; and wherein the high melt metal powder has a higher melting temperature than the low melt metal powder.

18. The thermally dissipative article according to claim 17, the water soluble ceramic powder comprising by weight percentage of the water soluble ceramic powder:

about 60% to 70% alumina flour ($Al_2O_3$);

about 15% to 25% zircon ($ZrSiO_4$) flour;

about 5% to 15% sodium hydrogen phosphate ($Na_2HPO_4$); and about 5% sugar.

* * * * *